United States Patent [19]

Schenk

[11] 4,396,060

[45] Aug. 2, 1983

[54] PIPE MANIFOLD FOR CENTRAL HEATING SYSTEMS

[76] Inventor: Artur Schenk, Eisinger Strasse 37, 7531 Neulingen-Göbringen, Fed. Rep. of Germany

[21] Appl. No.: 282,159

[22] Filed: Jul. 10, 1981

[51] Int. Cl.[3] ..... F28F 9/22

[52] U.S. Cl. ..... 165/176; 237/70; 237/137 R

[58] Field of Search ..... 165/176, 158, 163; 237/70, 71; 285/137 R

[56] References Cited

U.S. PATENT DOCUMENTS

| | | | |
|---|---|---|---|
| 1,833,314 | 11/1931 | Bruce | 165/176 X |
| 1,856,963 | 5/1932 | Martin | 165/176 |
| 2,351,425 | 6/1944 | Hanson | 165/176 X |

FOREIGN PATENT DOCUMENTS

| | | | |
|---|---|---|---|
| 2231112 | 1/1973 | Fed. Rep. of Germany | 165/176 |
| 2659348 | 2/1979 | Fed. Rep. of Germany | 165/176 |

*Primary Examiner*—Sheldon J. Richter
*Attorney, Agent, or Firm*—Joseph A. Geiger

[57] ABSTRACT

A welded dual-chamber pipe manifold with inlet pipe connectors and outlet pipe connectors arranged alternatingly in a single row, in alignment with a longitudinal partition wall of the manifold housing, the partition wall having alternating half-cone-shaped bulges and recesses in its proximate edge portion in alignment with the pipe connectors, intermediate portion of the proximate weld joint as well as the entire distal weld joint of the manifold housing being straight-line welds.

4 Claims, 2 Drawing Figures

PIPE MANIFOLD FOR CENTRAL HEATING SYSTEMS

BACKGROUND OF THE INVENTION

1. Field of the Invention

The present invention relates to pipe manifolds and, more particularly, to a welded dual-chamber pipe manifold adapted for use in central heating systems.

2. Description of the Prior Art

From the German Pat. No. 26 59 348 is known a welded pipe manifold for central heating systems which has alternating inlet and outlet pipes connected to a dual-chamber housing along a single row of pipe connectors. Two housing halves, welded to an intermediate partition wall, form an inlet chamber and an outlet chamber within the manifold. The partition wall extends in general alignment with the pipe connectors in a sinusoid-like outline, linking successive connectors alternatingly to the inlet chamber or to the outlet chamber.

The undulating outline of the partition wall requires matching edge outlines on both longitudinal edges of the housing halves, where they are welded to each other and to the partition wall.

SUMMARY OF THE INVENTION

It is the primary objective of the present invention to provide an improved dual-chamber pipe manifold which, while adding to the known advantages of the described prior art manifold, has components of geometrically simpler shape, for a saving in raw material cost and, more importantly, a greatly simplified welding operation, involving only straight-line weld joints on the manifold housing.

The present invention proposes to attain this objective by suggesting a dual-chamber pipe manifold with a longitudinal partition wall in alignment with the plane defined by the row of pipe connectors, the partition wall abutting against the pipe connectors with matching, alternatingly convex and concave semicircular lateral bulges and recesses, respectively. These bulges and recesses taper off into the plane of the partition wall.

Thus, while the proximate edge portion of the partition wall forms alternatingly oppositely inclined entry funnels to the inlet and outlet chambers, the distal edge portion is flat and straight, meaning that the adjoining edges of the two housing halves are likewise straight.

This novel partition wall configuration simplifies the weld joint at the junction between the two edges of the housing halves and the distal edge of the partition wall to such an extent that the welding operation along this joint can be speeded up and even mechanized, if necessary.

Further advantages of the invention derive from raw material savings on the partition wall and on the housing halves and from the elimination of alignment problems on the straight-line weld joint. Lastly, the suggested shape of the partition wall is also resulting in improved flow conditions in the two manifold chambers, due to the limitation of the transverse bulges and recesses to the proximate edge portion of the partition wall. This makes it possible to reduce the cross-sectional dimensions of the pipe manifold, without reducing the minimal flow cross section of the manifold chambers.

BRIEF DESCRIPTION OF THE DRAWINGS

Further special features and advantages of the invention will become apparent from the description following below, when taken together with the accompanying drawing which illustrates, by way of example, an embodiment of the invention which is represented in the various figures as follows.

DESCRIPTION OF THE PREFERRED EMBODIMENT

Figure 1:
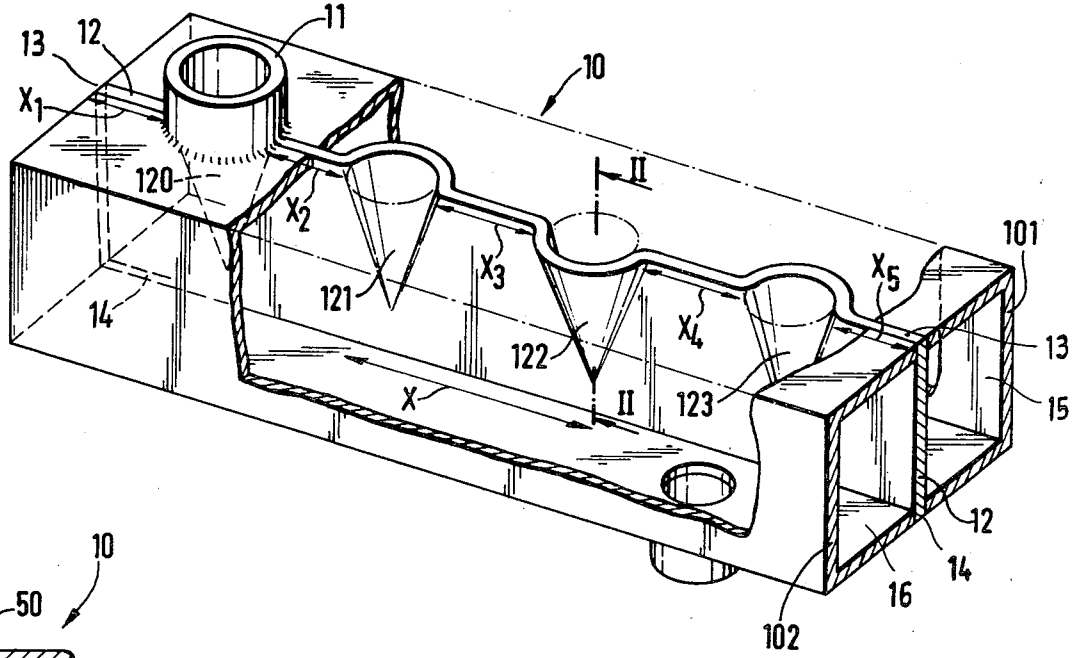
FIG. 1 shows, in a perspective view, a dual-chamber pipe manifold in accordance with the invention, portions of the manifold housing having been cut away.
Figure 2:
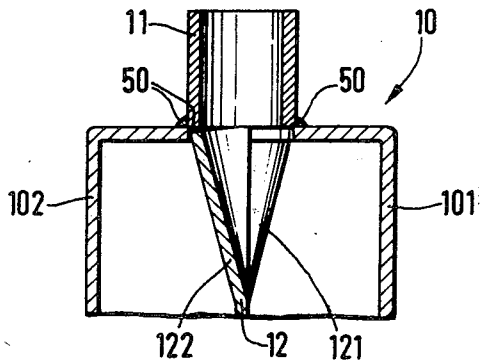
FIG. 2 is a transverse cross-section through the manifold of FIG. 1, taken along line II—II thereof.

As can be seen in FIG. 1, the pipe manifold 10 of the invention consists essentially of two elongated housing halves 101 and 102 and an intermediate partition wall 12, welded together along two weld joints 13 and 14 so as to form an inlet chamber 15 defined by the housing half 101 and the partition wall 12 and an outlet chamber defined by the housing half 102 and the partition wall 12.

A row of pipe connectors 11 for alternating inlet and outlet pipes is arranged on the outside of the manifold housing, in alignment with the partition wall 12 and straddling the two housing halves 101 and 102. In axial alignment with these pipe connectors 11, the partition wall 12 has alternatingly convex and concave semicircular lateral bulges 120 and 122 and recesses 121 and 123, alternatingly linking successive pipe connectors 11 to the inlet chamber 15 and to the outlet chamber 16. Accordingly, the proximate weld joint 13 of the manifold housing consists of a series of short straight-line welds $X_1 \ldots X_5$, interrupted by the circular welds 50 which attach the pipe connectors 11 to the manifold housing.

The lateral bulges 120, 122 and recesses 121, 123 in the partition wall 12 are preferably in the form of half-cones, or half-bells, the depth of their lateral deformation tapering off in the direction away from the pipe connectors 11 so that the distal edge of the partition wall 12 remains straight. Of course, it is also possible to use other geometric shapes for the tapering portion of the bulges and recesses 120 . . . 123, including, for example, an oblique cylinder or a bullet-nose shape.

The radius of the semicircular edge portions of the partition wall 12 is preferably the same as the radius of the connectors 11, so that a butt joint is obtained between the latter and the curved portions of the partition wal1 12. This butt joint, when welded at 50, conveniently also attaches the matchingly cutout housing half to the connector and partition wall.

Accordingly, it is not necessary to make any semicircular welds as part of the proximate weld joint 13, when the housing halves 101 and 102 and the partition wall 12 are initially welded together. It follows that, since both the proximate weld joint 13 and the distal weld joint 14 are straight-line welds, they readily lend themselves to a mechanization of the welding operation.

While the drawing and the foregoing description feature pipe connectors as part of the manifold assembly, it is of course also possible to directly weld the extremities of the inlet pipes and outlet pipes to the manifold housing in a configuration which is equivalent to that described above. Thus, the term "pipe connectors" should be understood to also stand for "pipe extremity".

It should be understood, of course, that the foregoing disclosure describes only a preferred embodiment of the invention and that it is intended to cover all changes and modifications of this example of the invention which fall within the scope of the appended claims.

I claim the following:

1. A welded dual-chamber pipe manifold comprising:

an elongated manifold housing composed of two housing halves of channel-like shape which are welded together along a proximate weld joint on one side of the housing and a distal weld joint on the opposite sides of the housing;

a generally flat partition wall longitudinally dividing the interior of the manifold housing into an inlet chamber and an outlet chamber, the partition wall extending from the proximate weld joint to the distal weld joint, being attached to both housing halves by said weld joints;

a row of pipe connectors arranged on the outside of the manifold housing in alignment with its proximate weld joints and with the plane of the partition wall, so as to straddle the latter, successive pipe connectors being connectable alternatingly to an inlet pipe and an outlet pipe; and a succession of alternatingly convex and concave lateral deformations in the form of substantially semicircular bulges and recesses in the proximate edge portion of the partition wall, in axial alignment with the pipe connectors and with matching semicircular cutouts in the associated wall portions of the two housing halves, the pipe connectors being welded to the housing halves at said cutouts and to the partition wall at said bulges and recesses, respectively, so that every even-numbered pipe connector leads to one manifold chamber and every odd-numbered pipe connector leads to the other manifold chamber; and wherein the depth of the lateral deformations in the proximate edge portion of the partition wall tapers off to zero in the direction away from the pipe connectors.

2. A pipe manifold as defined in claim 1, wherein the lateral deformations in the proximate edge portion of the partition wall are in the form of a half-cone in axial alignment with the associated pipe connector.

3. A pipe manifold as defined in claim 1 or claim 2, wherein the semicircular deformations in the proximate edge portion of the partition wall have substantially the same edge radius as the adjoining pipe connectors, being joined together by a butt weld;

the associated cutouts in the housing halves adjoin the partition wall deformations, being welded to the latter and to the pipe connectors by the same welds which form said butt welds; and each said weld which simultaneously joins edges of the pipe connector, of the partition wall, and of the manifold housing walls is part of a single circular weld joint at the extremity of the pipe connector.

4. A pipe manifold as defined in claim 3, wherein the partition wall has straight edge portions between its alternatingly bulging and recessed semicircular edge portions;

the housing halves and the partition wall are joined by a continuous straight-line weld joint at the distal edge of the partition wall and by an intermittent straight-line weld joint at said straight portions of the proximate edge of the partition wall; and the pipe connectors, the housing halves, and the semicircular proximate edge portions of the partition wall are joined by as many of said circular welds.

* * * * *